US009240290B2

(12) United States Patent
Kim

(10) Patent No.: US 9,240,290 B2
(45) Date of Patent: Jan. 19, 2016

(54) SWITCH FOR PREVENTING INRUSH CURRENT SHOCK AND CUTTING OFF STANDBY POWER

(76) Inventor: Byeongho Kim, Busan (KR)

( * ) Notice: Subject to any disclaimer, the term of this patent is extended or adjusted under 35 U.S.C. 154(b) by 502 days.

(21) Appl. No.: 13/812,016

(22) PCT Filed: Jul. 28, 2011

(86) PCT No.: PCT/KR2011/005549

§ 371 (c)(1),
(2), (4) Date: Jan. 24, 2013

(87) PCT Pub. No.: WO2012/015246

PCT Pub. Date: Feb. 2, 2012

(65) Prior Publication Data

US 2013/0126320 A1 May 23, 2013

(30) Foreign Application Priority Data

Jul. 30, 2010 (KR) ..... 10-2010-0073855
Feb. 7, 2011 (KR) ..... 10-2011-0010532
Apr. 5, 2011 (KR) ..... 10-2011-0030935

(51) Int. Cl.
*H01H 7/00* (2006.01)
*H01H 13/50* (2006.01)
*H01H 3/50* (2006.01)

(52) U.S. Cl.
CPC ..... *H01H 7/00* (2013.01); *H01H 3/503* (2013.01); *H01H 13/50* (2013.01)

(58) Field of Classification Search
CPC ..... H01H 7/00; H01H 3/503; H01H 13/50
USPC ..... 307/125, 141
See application file for complete search history.

(56) References Cited

U.S. PATENT DOCUMENTS 6,373,227 B2 * 4/2002 Nakashimo ..... 320/134

FOREIGN PATENT DOCUMENTS

| | | | |
|---|---|---|---|
| JP | 11178212 | | 7/1999 |
| JP | 2000125226 | | 4/2000 |
| KR | 1020090052275 | A | 5/2009 |
| KR | 1020090121424 | A | 11/2009 |
| KR | 100945210 | B1 | 3/2010 |

* cited by examiner

*Primary Examiner* — Hal Kaplan
(74) *Attorney, Agent, or Firm* — Bacon & Thomas, PLLC

(57) ABSTRACT

The present invention is provided with a delay unit for applying a function of a double-pole contact switch and a control function of an activation switch, so as for the contact switch and the activation switch not to operate simultaneously when turned on. Accordingly, when a predetermined time elapses after the double-pole contact switch operates first to prevent an inrush current shock, the activation switch generates a control signal to safely operate an internal circuit such as a central processing device or a control device, so that an electronic product is turned on without an electrical shock or a significant spark. Moreover, if power is cut off by software or the internal circuit is turned off in response to a control signal of the activation switch after an ON button of the electronic product is pressed, the double-pole contact switch is automatically turned off immediately or over a time interval, so that standby power is cut off completely, safely, conveniently, and effectively.

3 Claims, 12 Drawing Sheets

(a)

(b)

(c)

(d)

(c)

SWITCH FOR PREVENTING INRUSH CURRENT SHOCK AND CUTTING OFF STANDBY POWER

CROSS-REFERENCE TO RELATED APPLICATION

This application claims the benefit of Korean Patent Application No. 10-2010-0073855, filed on Jul. 30, 2010 and Korean Patent Application No. 10-2011-0010532, filed on Feb. 7, 2011 and Korean Patent Application No. 10-2011-0030935, filed on Apr. 5, 2011 in the Korean Intellectual Property Office, the disclosure of which is incorporated herein by reference.

TECHNICAL FIELD

The present invention relates to a switch for preventing inrush current shock and cutting off standby power, and more particularly, to a switch for preventing inrush current shock and cutting off standby power, which can effectively prevent component damage, malfunction, deterioration of electricity quality, or the like, and cut off unwanted standby power effectively and completely, without changing a power supply mechanism in existing electrical products and electronic products (hereinafter referred to as electronic products). Here, the component damage, malfunction, quality deterioration, or the like occurs because of an electrical shock by an inrush current which occurs when an electrical product is turned on, and the function of cutting off the unwanted standby power is performed when an electrical product is turned off.

BACKGROUND ART

Generally, a transient phenomena, where a current higher than a normal current flows just after power is supplied to a power distributing circuit or an electrical device, occurs, and the transient phenomena is referred to as an inrush current. A hot load current that occurs in the first step of an inrush current occurs at the same time with supplying power, and an amount of the hot load current is several times greater than, or tens times greater than, that of normal current. The hot load current causes deterioration of a quality of the electronic product as well as deterioration of a power distributing device, performance degradation of a power distributing device and protection coordination inability. The hot load current occurring in the first step of the inrush current includes an initial inrush current occurring just after being applied to a line, a magnetizing current in a device, such as a motor of a transformer or the like, having a core, a current for increasing a temperature of an incandescent lamp, etc. intensity of the hot load current is tens times greater than that of a normal current, but a continuous time of the hot load current is very short, such as a several Hz. To decrease an electrical shock of an inrush current impacting on electronic products, negative temperature coefficient thermistor (NTC thermistor) or the like is used, but NTC thermistor cannot perform a function of radiating heat. Also, if heat is not radiated, the NTC thermistor cannot perform an original function, and in this case, because heat is diffused to an ambient space, a space in which other semiconductor components are disposed, is heated, and thus, an embeded environment may be deteriorated.

Generally, in use of electronic products such as home appliances, office machines, industrial machines or the like, it is well known that an energy consumption for standby power is significant. For example, in the case of KOREA, it is well known that an energy consumption for standby power is almost 11% of a total energy consumption in a household each year. If this is expanded to 1.5 million households, energy corresponding to 5.2 trillion won is consumed for standby power each year.

The most effective method for preventing the standby power is to separate a portion (a plug), through which power is inputted from the outside, from electronic products, and that is, the method is to pull the plug out of the socket. However, this method make a user inconvenient, and thus, the method is invalid. Also, a method of using various types of auto or manual multi-outlet power strip including a contact switch is provided; but, in this case, when power is to supplied, switches in the multi-outlet power strip and the electronic products have to be doubly operated.

Korean Patent Registration No 10-0945213 titled "APPARATUS FOR CUTTING OFF STANDBY POWER AND METHOD FOR CONTROLLING THEREOF" discloses an apparatus for cutting off standby power including a knob switch, a first switching unit, a second switching unit and a control unit. In the related art, when electronic products turn on, an electrical shock or a spark with an inrush current occurs in the electronic products. That is, the related art impacts electrical quality according to an over current and a change of a voltage value by an inrush current when the electronic products turn on, and thus, the electronic products may be impacted or may be broken.

FIG. 1 is an exemplary diagram showing a time-current characteristic curve for describing an inrush current.

Referring to FIG. 1, an inrush current tens times greater than a normal current for charging a capacitor occurs when an electronic product turns on. If the inrush current is not controlled or is not prevented, a current demand in a line rapidly changes on a very larger scale than an operation current of root mean square RMS. An excessive current may damage devices, electrical elements and electronic components, such as a fuse, solder joint or the like, or may transform them, and may have various bad influences on them.

Moreover, an asymmetric voltage transferred to a control circuit or various components through a power supply may be a cause of generating a breakdown in main components. A Switching Mode Power Supply SMPS, which is mainly used as a power supply among power supplies converting an alternating current AC to a direct current DC applied to various devices, such as computers, communication devices, home appliances, or the like, has a delay time (for example, 0.5 sec) during a switching process of converting an alternating current to a direct current, and generates a noise and electromagnetic waves.

To solve the limitation in the above-described related art, a present invention is provided based on understanding the inrush current and the power supply.

DISCLOSURE OF INVENTION

Accordingly, the present invention is directed to provide a switch for preventing inrush current shock and cutting off standby power which substantially obviates one or more problems due to limitations and disadvantages of the related art. An aspect of the present invention is directed to providing a switch for preventing inrush current shock and cutting off standby power which is installed in an incoming line of a power supply to prevent inrush current shock and decrease a spark, and can cut off standby power safely, perfectly and effectively even though a plug connects to a socket, such that a convenience is maximized without changing a power supply mechanism in existing electrical products and electronic products.

Another aspect of the present invention is directed to providing a switch for preventing inrush current shock and cutting off standby power, which applies a contact switch and an activation switch, is provided with a delay unit so that the contact switch and the activation switch not to operate simultaneously when an electronic product turns on or on-button is pushed, and make a double-pole contact switch operate first to prevent an inrush current shock. Also, when a predetermined time elapses after a double-pole contact switch operates first to prevent an inrush current shock, and a uniform voltage is supplied from a power supply to a control circuit and each of components, the switch according to the present invention makes the activation switch generate a control signal so that a contact-less switch in an internal circuit (a central processing unit or a control unit) turns safely on an electronic product without electrical shock.

The other aspect of the present invention is directed to providing a switch for preventing inrush current shock and cutting off standby power, which automatically turn off a double-pole contact switch immediately or after certain times to cut off standby power safely, perfectly and effectively by using a controller which cut off standby power if a internal control circuit turns off by cutting off power with a software in the internal control circuit (for example, a washing machine automatically turns off if a washing is finished), by receiving a control signal from a remote controller, or by turning on an on-button to make the activation switch generate a control signal.

To achieve these and other advantage and in accordance with the purpose of the invention, as embodied and broadly described herein, there is provided a switch for preventing inrush current shock and cutting off standby power, which includes; a first terminal and a second terminal 22 and 24 contacting external power supplied to drive an electronic product; a first opening and closing terminal and a second opening and closing terminal 23 and 25 electrically contacting an internal circuit 1 of the electronic product; a power-on unit 30 contacting or opening the first and second opening and closing terminals 23 and 25 and the first and second terminals 22 and 24, and contacting the first and second opening and closing terminals 23 and 25 and the first and second terminals 22 and 24 to apply the external power to the internal circuit 1 of the electronic product; an activation switch generating a control signal depending on an operation of the power-on unit 30 to control the internal circuit 1 of the electronic product; and a delay unit 50 for making the activation switch 70 not operate while the power-on unit 30 is trying to contact the first and second opening and closing terminals 23 and 25 and the first and second terminals 22 and 24, delaying a predetermined time after the first and second opening and closing terminals 23 and 25 contact the first and second terminals 22 and 24 with the power-on unit and the external power is first applied to the internal circuit 1 of the electronic product, and making the activation switch 70 generate the control signal.

In the present invention, the power-on unit 30 includes an operation protrusion 53 making the activation switch 70 generate the control signal, an ON button 32 integrally formed with the operation protrusion 53, and a moving block 40 elastically supported to be disposed between the ON button 32 and the first and second terminals 22 and 24 by a spring 34*b* and transferred by the ON button 32, and the delay unit 50 may include at least one of a swing lever 54 and a guide 58 making the operation protrusion 53 not cause the activation switch 70 to operate while the ON button 32 is transferring the moving block 40 to contact the first and second opening and closing terminals 23 and 25 to the first and second terminals 22 and 24.

The switch according to the present invention may further include a controller 80 controlling the first and second opening and closing terminals 23 and 25 to separate from the first and second terminals 22 and 24 to cut off a standby power; a magnet 46 integrally formed with the moving block 40; and an electromagnet 48 disposed at a position facing the magnet 46, separating from the magnet 46 depending on a polarity of a magnetic field according to the control signal of the activating switch, and transferring the moving block to separate the first and second opening and closing terminals 23 and 25 from the first and second terminals 22 and 24.

ADVANTAGEOUS EFFECTS

According to the embodiments of the present invention, because a function of a contact switch is performed by the power-on unit 30, the present invention has a function of a double-pole contact switch and a function of controlling a contact-less switch (semiconductor) of an internal circuit with the activation switch 70. Therefore, the present invention can maximize a user's convenience safely without changing a power supply mechanism in existing electrical products, can prevent electrical shock and a spark occurring because of an electrical shock by an inrush current occurring when an electrical product is turned on, and can completely cut off standby power by using a turning-off state of a double-pole contact switch. Particularly, when an electronic product turns on, a double-pole contact switch firstly operates with the delay unit 50, which makes the activation switch 70 not operate, by the power-on unit 30. Therefore, without electrical shock and a great spark occurring because of an inrush current, power is applied to an internal circuit of an electronic product through a power supply. Then, after a predetermined time, the activation switch 70 generates a control signal to operate the internal circuit 1, and thus, the electronic product turns on. Therefore, without changing a power supply mechanism in existing electrical products, the internal circuit (a control circuit, that is, a central processing unit or a control unit) can safely turn on the electronic product at one operation, and thus, can maximize a user's convenience. Moreover, in the switch for preventing inrush current shock and cutting off standby power according to the present invention, if the electronic product turns off by software of the internal circuit or the internal circuit turns off in response to a control signal (OFF signal) of the activation switch which the ON button 32 operates, the contact switch can be automatically turned off immediately or after a predetermined time as occasion demands. And thus, standby power can be cut off conveniently and efficiently.

BRIEF DESCRIPTION OF DRAWINGS

The accompanying drawings, which are included to provide a further understanding of the invention and are incorporated in and constitute a part of this application, illustrate embodiments of the invention and together with the description serve to explain the principle of the invention. In the drawings.

VEST MODES FOR CARRYING OUT THE INVENTION

The switch according to the vest mode for carrying out the invention includes:

A switch for preventing inrush current shock and cutting off standby power, the switch comprising:

a first terminal and a second terminal contacting external power supplied to drive an electronic product;

a first opening and closing terminal and a second opening and closing terminal electrically contacting an internal circuit of the electronic product;

a power-on unit contacting or opening the first and second opening and closing terminals and the first and second terminals, and contacting the first and second opening and closing terminals and the first and second terminals to apply the external power to the internal circuit of the electronic product;

an activation switch generating a control signal depending on an operation of the power-on unit to control the internal circuit of the electronic product; and a delay unit for making the activation switch not operate while the power-on unit is trying to contact the first and second opening and closing terminals and the first and second terminals, delaying a predetermined time after the first and second opening and closing terminals contact the first and second terminals with the power-on unit and the external power is first applied to the internal circuit of the electronic product, and making the activation switch generate the control signal.

MODES FOR CARRYING OUT THE INVENTION

Reference will now be made in detail to the exemplary embodiments of the present invention, examples of which are illustrated in the accompanying drawings. Wherever possible, the same reference numbers will be used throughout the drawings to refer to the same or like parts. Hereinafter, embodiments of the present invention will be described in detail with reference to the accompanying drawings.

Figure 1:
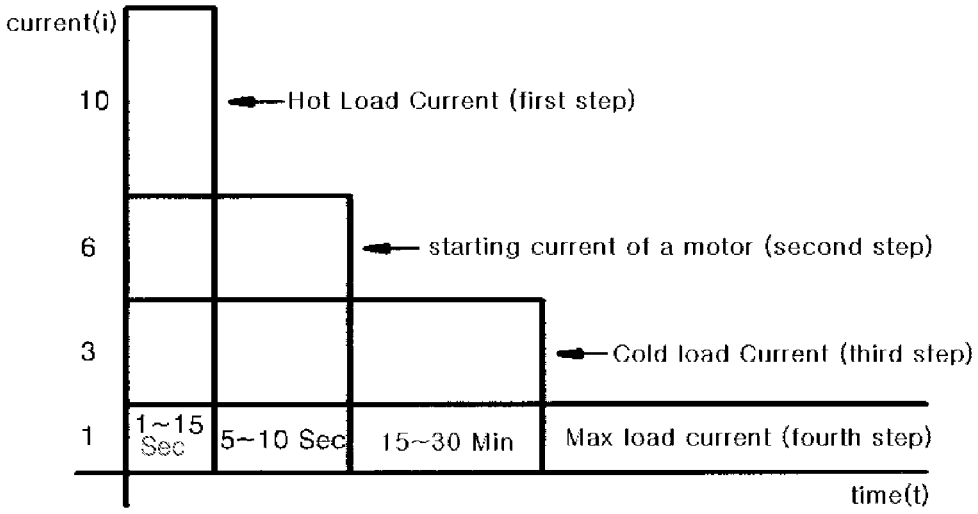
FIG. 1 is an exemplary diagram showing a time-current characteristic curve for describing an inrush current.
Figure 2:
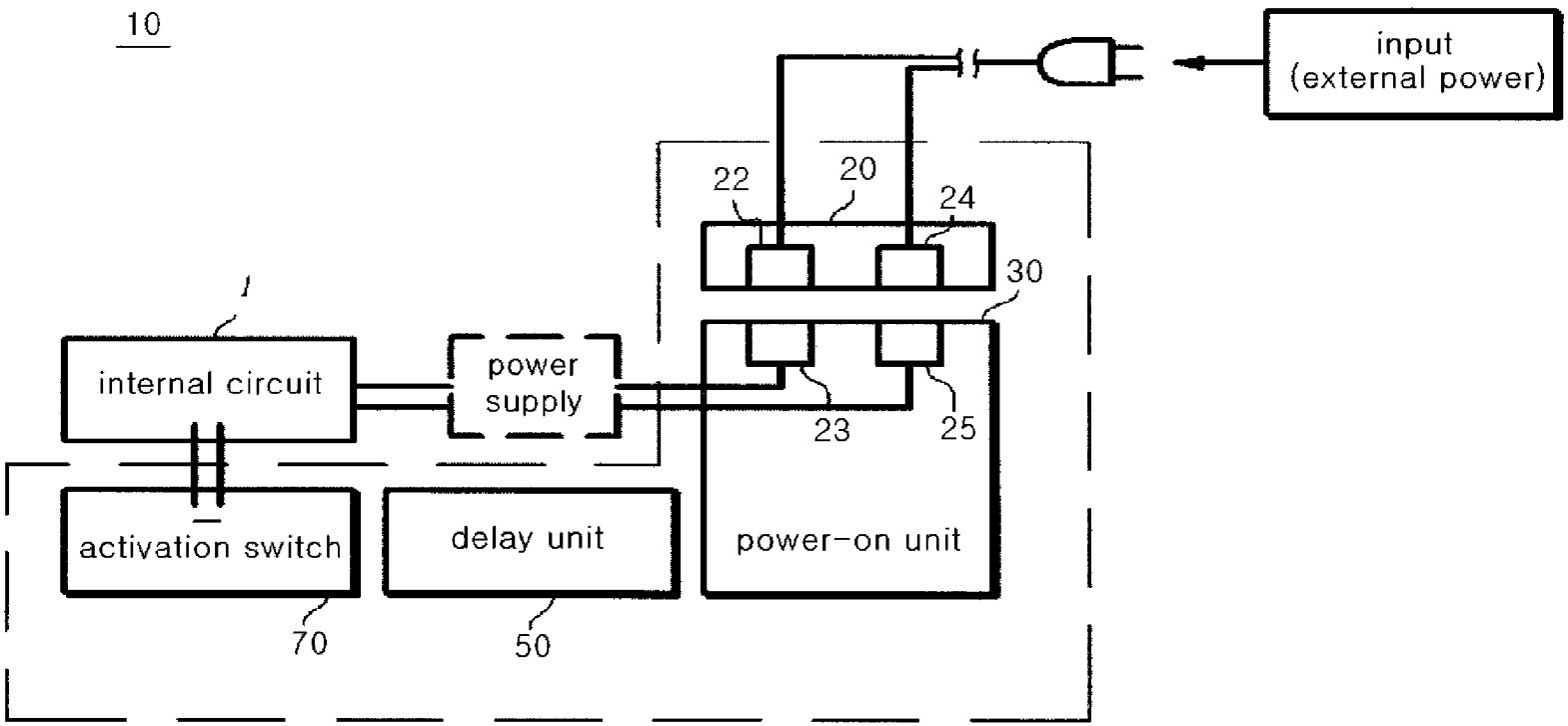
FIG. 2 is an exemplary block diagram for describing a switch for preventing inrush current shock and cutting off standby power according to the present invention.
Figure 3A:
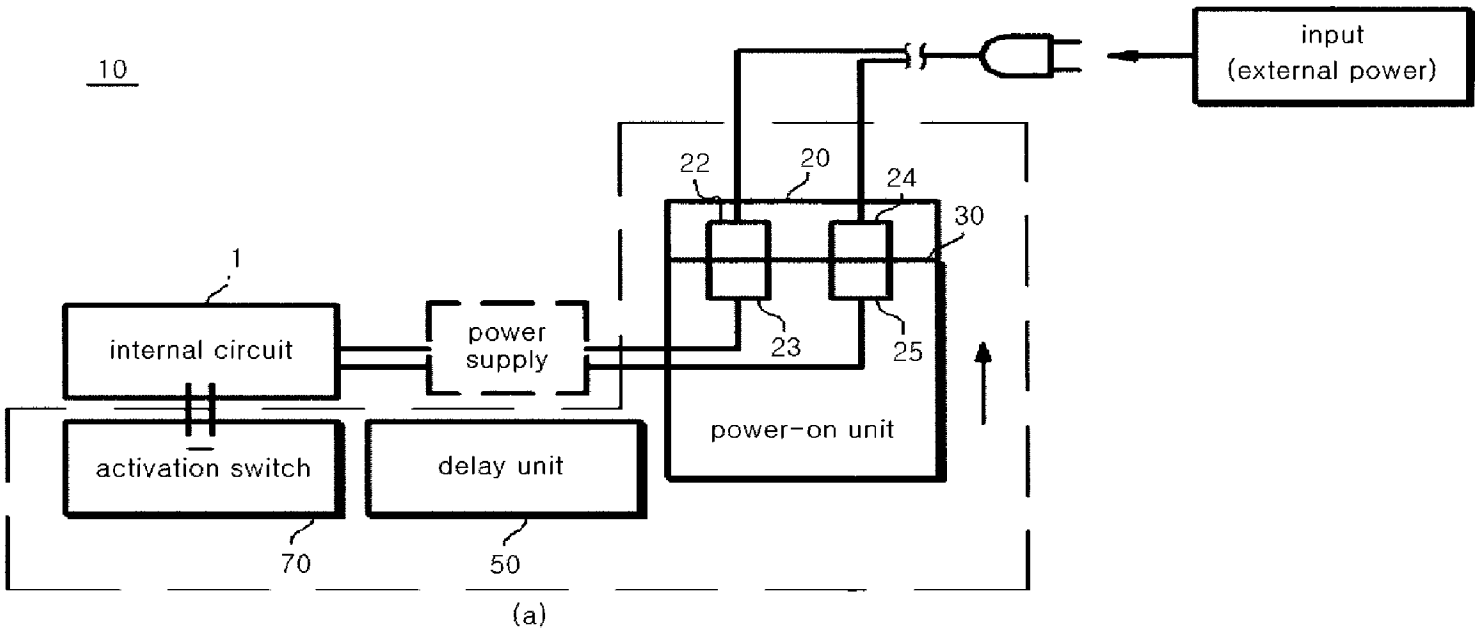
FIGS. 3*a* and 3*b* are exemplary diagrams for describing an operation of a switch for preventing inrush current shock and cutting off standby power shown in FIG. 2.
Figure 3B:
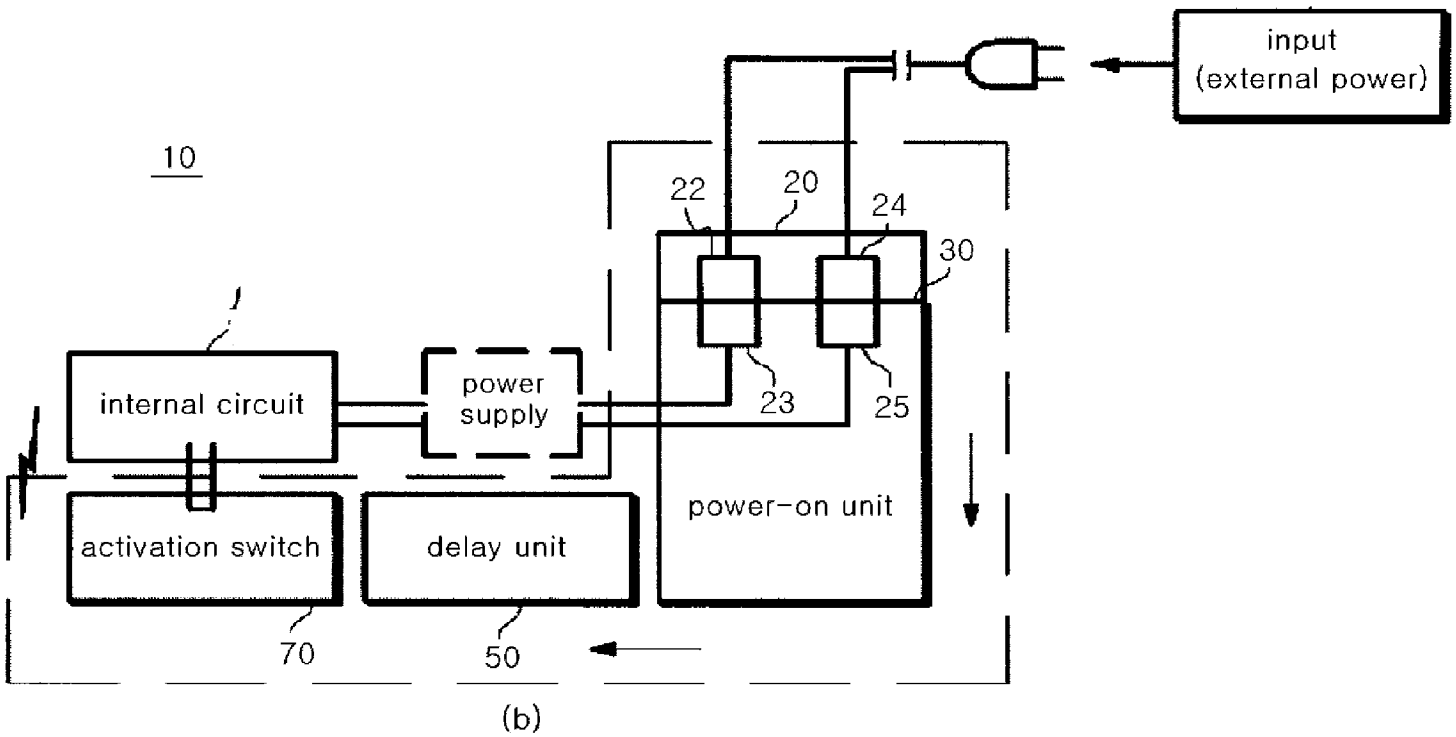

FIG. 2 is an exemplary block diagram for describing a switch for preventing inrush current shock and cutting off standby power according to the present invention, and FIGS. 3*a* and 3*b* are exemplary diagrams for describing an operation of a switch for preventing inrush current shock and cutting off standby power shown in FIG. 2. Here, FIG. 3*a* is an exemplary diagram illustrating a state in which external power is being applied to an internal circuit 1, and FIG. 3*b* is an exemplary diagram illustrating a state in which a delay unit 50 is driven to turn on an activation switch 70 to operate the internal circuit 1 in FIG. 3*a*.

Referring to FIGS. 2, 3*a* and 3*b*, a switch 10 for preventing inrush current shock and cutting off standby power according to the present invention first applies external power to the internal circuit 1 through a power supply of an electronic product, and later makes the activation switch 70 generate a control signal (ON) to turn on the electronic product, and if the internal circuit 1 turns off, the switch cuts off power applied to the power supply.

The switch 10 according to the present invention provides a function of a contact switch applying external power to the internal circuit 1 of an electronic product, and thus, when the internal circuit 1 turns off, it is possible to perfectly cut off standby power in an incoming line of a power supply by using a function of a contact switch. For example, in the related art computer, even though a switch in a main body of the computer turns off so as to turn off power of the computer, standby power is not cut off, and thus, a plug of a main body of the computer has to be separated from a socket or a separate multi-outlet power strip (multiple-tap), in which a double-pole contact switch is installed, has to be used, so as to cut off standby power. However, according to the present invention, standby power can effectively be cut off with only a main body switch (a switch 10 according to the present invention) installed in a main body of the computer. Also, after external power is first applied to the internal circuit 1, and a predetermined time, which is predetermined by the delay unit 50, elapses, the internal circuit 1 is operated by controlling of the activation switch 70, and thus, inrush current shock or a spark, which occurs when an electronic product turns on, can be effectively cut off, and a breakdown in components depending on a change of a voltage value can be safely prevented. Here, the predetermined time may be about one second in consideration to a short continuous time of inrush current of Hot Load Current and a delay time during the conversion of AC to DC in a power supply. Therefore, when about one second elapses after a contact switch is operated, the activation switch may generate a control signal (ON signal) to turn on an electronic product, but it is possible to turn on an electronic product after more time intervals according to a system.

Referring again to FIG. 2, a switch 10 for preventing inrush current shock and cutting off standby power according to the present invention includes a terminal board 20, a power-on unit 30, an activation switch 70 and a delay unit 50. Here, the terminal board 20 includes a first terminal 22 and second terminal 24 to each of which external power supplied to drive an electronic product contacts. A first opening and closing terminal and a second opening and closing terminal are respectively disposed at a portion corresponding to the first terminal 22 and the second terminal 24. One end of each of the first opening and closing terminal and the second opening and closing terminal can elastically contact and separate from each of the first terminal 22 and the second terminal 24, and other end of each of the first opening and closing terminal and the second opening and closing terminal electrically contacts the internal circuit 1 such that external power is inputted to the internal circuit 1 or be cut off. Here, the first opening and closing terminal and the second opening and closing terminal may be integrally formed with the power-on unit 30 or may be formed in the terminal board 20. That is, a shape and a disposing position of the first and second terminals 22 and 24, and the first and second opening and closing terminals 23 and 25 may be changed as occasion demands, and various shapes applied to a general switch may be applied to the terminals.

The activation switch 70 generates a control signal to turn on or off an internal circuit of an electronic product. Also, the delay unit 50 makes the activation switch 70 turn on to generate a control signal after power is applied to the internal circuit 1 of an electronic product with the power-on unit 30 and a predetermined time elapse.

The switch 10 for preventing inrush current shock and cutting off standby power according to the present invention, as shown in FIGS. 3*a* and 3*b*, makes an electronic product operate through two processes to safely prevent inrush current shock and a spark. That is, the switch 10 for preventing inrush current shock and cutting off standby power according to the present invention operates the power-on unit 30 installed in an electronic product just like a general switch and a button when a user want to use the electronic product. Then, the first and second terminals 22 and 24, and the first and second opening and closing terminals 23 and 25 to which the internal circuit is electrically connected, contact each other, and thus, external power is applied to the internal circuit 1. After power is applied to the internal circuit 1, the activation unit 70 operates with the delay unit 50. Then, the activation switch generates a control signal, and thus, the internal circuit 1 of the electronic product operates and the electronic product turns on.

In the switch 10 for preventing inrush current shock and cutting off standby power according to the present invention, the activation switch 70 controls a contact-less switch (semiconductor) in the internal circuit.

The contact-less switch may be configured with a semiconductor device, such as a transistor, a diode, a SCR, a TRIAC, or the like, which does not move mechanically but can open or close a circuit. A tact switch, a touch switch or the like is used as the activation switch 70. For example, in the present invention using the tact switch, if the activation button 71 is pushed, a contact point A and a contact point B contact each other to generate a control signal (ON or OFF) to control the internal circuit, and then, the activation button 71 return to an initial position with a spring (S) to separate the contact point A from the contact point B. Therefore, an on-control signal alternates with an off-control signal whenever the activation button 71 is pushed.

Hereinafter, embodiments of the present invention will be described in detail with reference to FIGS. 4 to 7, and in FIGS. 1 to 7, the same reference numbers will be used to refer to the same or like parts. Also, in the drawings, a configuration, an operation and an effect well known to those skilled in the related art about various switches for cutting off standby power is not drawn or is briefly drawn, and parts for the present invention is drawn in detail.

Figure 4:
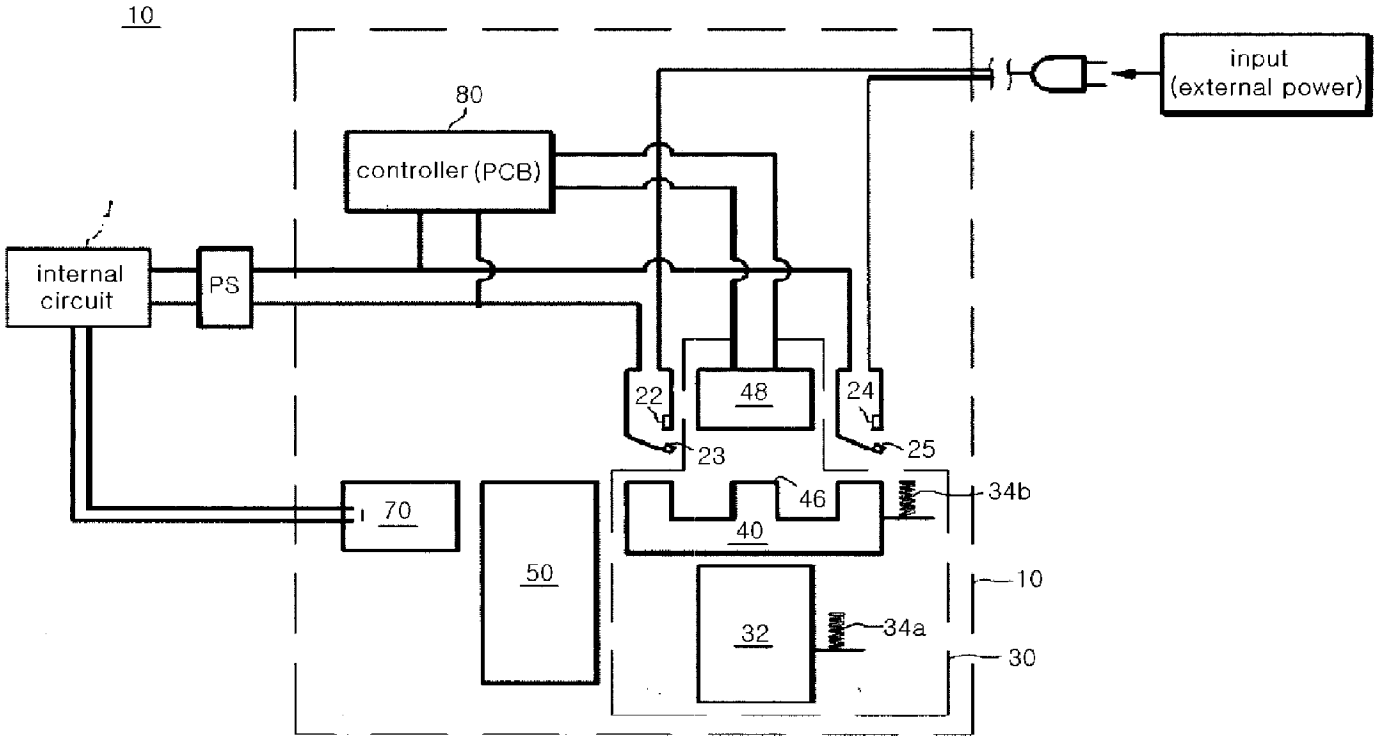
FIG. 4 is an exemplary block diagram for describing a switch for preventing inrush current shock and cutting off standby power according to an embodiment of the present invention.
Figure 5:
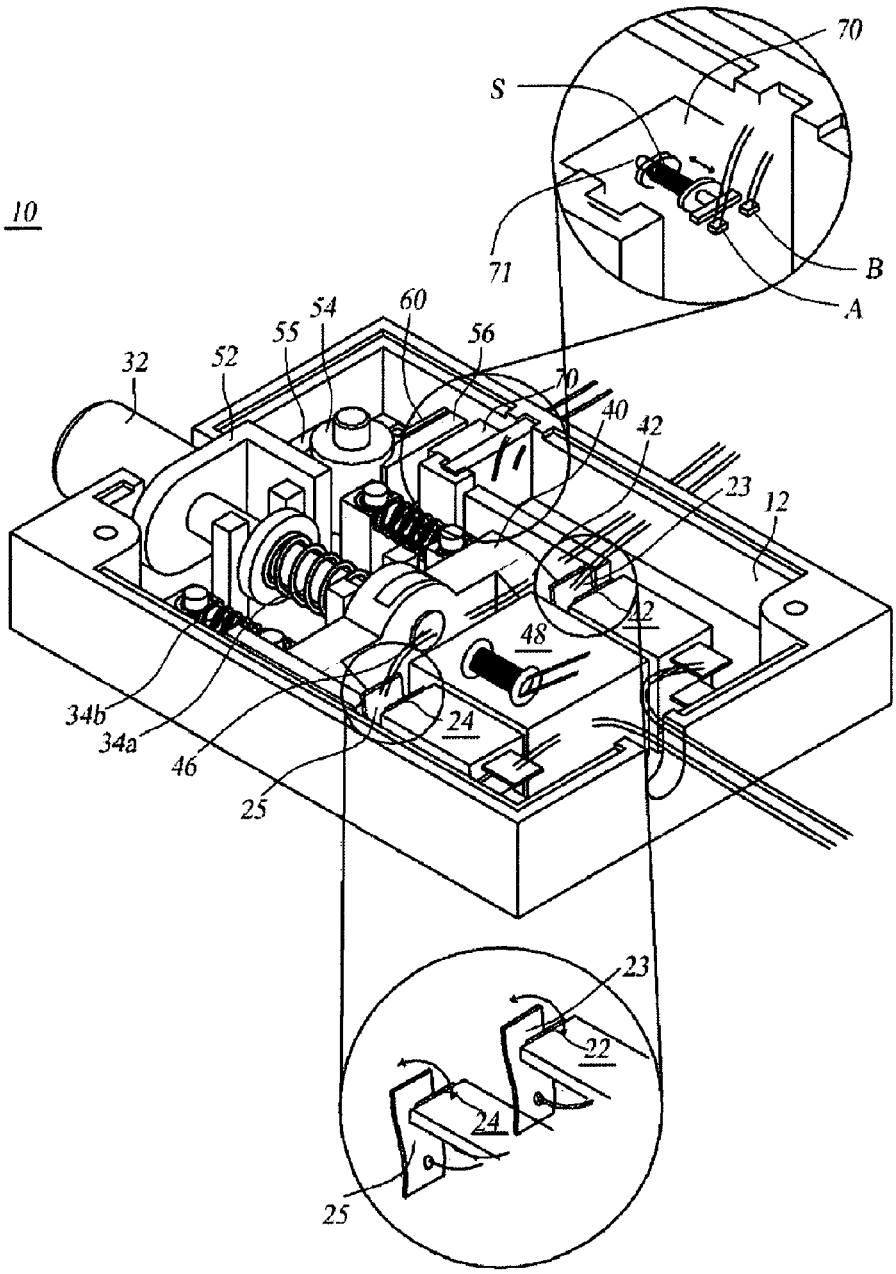
FIG. 5 is a schematic perspective view illustrating main configurations of a switch for preventing inrush current shock and cutting off standby power according to an embodiment of the present invention.

FIG. 4 is an exemplary block diagram for describing a switch for preventing inrush current shock and cutting off standby power according to an embodiment of the present invention, and FIG. 5 is a schematic perspective view illustrating main configurations of a switch for preventing inrush current shock and cutting off standby power according to an embodiment of the present invention.

A switch 10 for preventing inrush current shock and cutting off standby power according to an embodiment of the present invention, as shown in FIG. 2, includes a terminal board 20, a power-on unit 30, an activation switch 70 and a delay unit 50, may be applied to existing electronic products without changing a power supply mechanism in existing electrical products, can effectively prevent direct damage or malfunction occurring in a transformer or components included in the transformer, and can cut off unwanted standby power effectively and completely. Here, the direct damage or the malfunction occurs because of an electrical shock by an inrush current shock which occurs when an electrical product is turned on, and the function of cutting off the unwanted standby power is performed when an electrical product is turned off.

In the switch 10 for preventing inrush current shock and cutting off standby power according to an embodiment of the present invention, a first and second opening and closing terminal 23 and 25, a first and second terminal 22 and 24, a power-on unit 30, a delay unit 50 and an activation switch 70 are disposed in one case 12. That is, because the switch according to present invention is formed in one unit by using the case 12, the switch can be directly installed in an electronic product like a tact switch. Particularly, in the switch 10 according to the present invention, a controller 80 (formed in a PCB shape in the embodiment) is disposed inside the case such that a contact switch automatically turns off when an internal circuit 1 of an electronic product turns off (deactivated), and thus, a design change or a remanufacturing of an existing electronic product is not needed. Moreover, in a design for an electronic product to adopt the switch 10 according to the present invention, a controller 80 shown in FIG. 4 may be integrally formed with an internal circuit 1.

Referring to FIGS. 4 and 5, in the switch 10 for preventing inrush current shock and cutting off standby power according to an embodiment of the present invention, the terminal board 20 includes a first terminal 22 and second terminal 24 to each of which external power supplied to drive an electronic product contacts. Also, an electromagnet 48, which operates with an internal circuit 1 or a controller 80 when external power is applied to the internal circuit 1 through contact points between the first and second opening and closing terminals 23 and 25, and the first and second terminals 22 and 24, is disposed in the terminal board 20. Here, a solenoid coil is winded in a bobbin and solenoid coil terminals are connected to the power lines, such that the electromagnet 48 is formed. A controller 80 (a controller 80 shown in FIGS. 5 and 7 can be disposed in any position inside a case 12 for user's convenience) transmits a current through the solenoid coil to generate a magnetic field in the electromagnet 48 if an internal circuit 1 of an electronic product turns off, when the controller 80 is being supplied with power. At this point, the electromagnet 48 has the same polarity as that of a magnet 46 contacting the electromagnet 48, and thus, the electromagnet 48 and the magnet 46 push each other. Therefore, contact points between the first and second opening and closing terminals 23 and 25, and the first and second terminals 22 and 24 are opened. Then, power is not supplied to the electromagnet 48, and thus, the electromagnet loses magnetic force. That is, the controller 80 is supplied with power when external power is applied to the internal circuit 1 with a power-on unit 30. The controller 80 transmits a current to the electromagnet 48 such that the electromagnet 48 has magnetic and the electromagnet 48 generates repulsive force against the magnet 46, by detecting deactivation of the internal circuit 1, generating of a control signal (OFF signal) of an activation switch 70, or detecting a current transmission in an electronic product. And thus, a moving block 40 returns to an initial position with a spring 34*b*, and contact points between the first and second opening and closing terminals 23 and 25, and the first and second terminals 22 and 24 are separated to cut off standby power.

In the switch 10 for preventing inrush current shock and cutting off standby power according to an embodiment of the present invention, an ON button 32, which can be integrally formed with a moving block 40, may be formed in a power-on unit 30 which makes external power be applied to an internal circuit 1 by contacting the first and second terminals 22 and 24, and the first and second opening and closing terminals 23 and 25. However, an ON button may be elastically supported by a spring 34*a*, one end of the ON button 32 may protrude to the outside of a case 12, and the ON button may slide. The ON button 32 may be formed in various shapes such that a user push the ON button 32 to turn on or off power of an electronic product, based on the present invention. A moving block 40 is elastically supported by a spring 34*b* to be disposed between a terminal board 20 and an ON button 32. The moving block 40 moves toward a terminal board 20 with an ON button 32 to contact the first and second terminals 22 and 24, and the first and second opening and closing terminals 23 and 25. At this point, a magnet 46 disposed at the moving block 40 closely contacts the electromagnet 48, and thus, the contact state of the first and second terminals 22 and 24, and the first and second opening and closing terminals 23 and 25 is maintained. At this point, the electromagnet 48 does not form a magnetic field. Moreover, it is natural that the magnetic force of the magnet 46 is larger than elastic restoring force of the spring 34*b*. To this end, protrusions 42 for pushing one side of each of the first and second opening and closing terminals 23 and 25 are respectively formed in either side of the moving block 40, and the magnet 46 is disposed in a central part of the moving block 40. If a current flows through the electromagnet 48 according to a control of the internal circuit 1 or the controller 80, the magnetic field occurs, and thus, repulsive force occurs between the electromagnet 48 and the magnet closely disposed, and therefore, the electromagnet 48 and the magnet 46 pushes each other. Here, the electromagnet 48 may be disposed at the moving block 40 and the magnet 46 may be disposed at the terminal board 20 in another embodiment of the present invention. In the above description, the magnet and the electromagnet are used as the power-on unit 30 which contacts or separates from the first and the second terminals 22 and 24, and the first and second opening and closing terminal 23 and 25. However, a general earth leakage breaker or a general switch may be used as the power-on unit 30 and it is apparent that the configuration and the shape of the power-on unit 30 can be changed to various configuration and shapes.

In the switch 10 for preventing inrush current shock and cutting off standby power according to the present invention, an activation switch 70 generates a control signal to operate an internal circuit 1 of an electronic product. Also, in the state power is being applied to an internal circuit 1 of an electronic product, after a predetermined time elapses, the delay unit 50 makes the activation switch 70 operate to make a control signal be generated.

Here, in the delay unit 50, an operation protrusion 53 is integrally formed with an ON button 32 in which a spring (S) is inserted, and a guide 58 is formed such that an activation switch 70 does not operate when an ON button 32 operates. Therefore, when an ON button 32 returns to an initial position, an operation protrusion 53 pushes the activation button 71 to contact a contact point A to a contact point B, and thus, a control signal is generated. Here, a predetermined time may be controlled with a spring 34*a* and an elasticity of the springs (S).

The delay unit 50 may be configured as described below. That is, the delay unit 50 may be configured using a gas or a hydraulic type absorber. When an ON button 32 pushes a moving block 40, and thus, the first and second opening and closing terminals 23 and 25, and the first and second terminals 22 and 24 contact each other, an operation protrusion 53 pushes a compression protrusion of an absorber to compress the compression protrusion. Also, when the ON button 32 returns to an initial position, the compression protrusion of the absorber slowly returns to an initial position to operate an activation switch. At this point, the activation switch 70 may be a touch switch.

Figure 6:
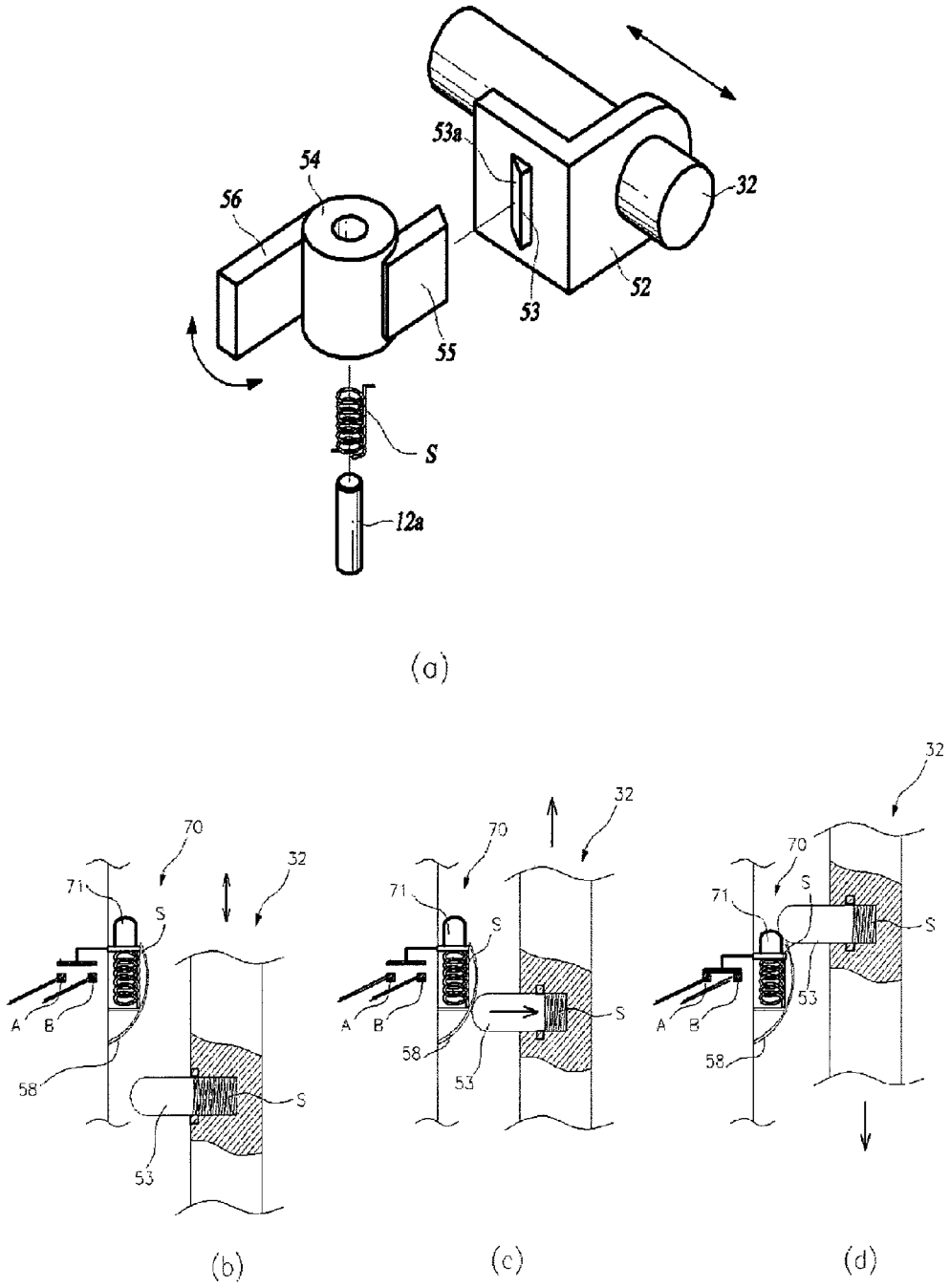
FIG. 6 is an exploded perspective view for describing a delay unit applied to a switch for preventing inrush current shock and cutting off standby power according to an embodiment of the present invention.

FIG. 6*a* is an exploded perspective view for describing a delay unit 50 applied to a switch for preventing inrush current shock and cutting off standby power according to an embodiment of the present invention. Referring to FIG. 6, in the switch 10 for preventing inrush current shock and cutting off standby power according to an embodiment of the present invention, the delay unit 50 operates with the ON button 32, and after time gap, the delay unit 50 operates the activation switch 70, such that a safe delay effect can be gained and the delay unit 50 can be configured with simple elements.

To describe in detail, in the switch 10 according to the present invention, the delay unit 50 includes an operation protrusion 53 and a swing lever 54, and thus, when the ON button 32 pushes the moving block 40 to the terminal board 20, the activation switch 70 does not operate. A magnet 46 in the moving block 40 is closely adjacent to an electromagnet 48 (at this point, the electromagnet does not perform a function of an electromagnet), and thus, the first and second opening and closing terminals 23 and 25, and the first and second terminals 22 and 24 to contact each other, and external power is applied to the internal circuit 1. Then, when the ON button 32 moves backward (moves to an initial position), the activation switch 70 operates to generate a control signal, and thus, the internal circuit 1 is activated and an electronic product operates. To this end, the operation protrusion 53 is disposed at the ON button 32, and slides depending on a movement of the ON button 32. Also, the swing lever 54 is disposed in the case 12 such that the swing lever 54 rotates to either side of the sliding directions of the operation protrusion 53. Moreover, when the ON button 32 slides to a direction opposite to the terminal board 20, the swing lever 54 rotates with the operation protrusion 53 to operate the activation switch 70.

The delay unit 50 may be extended using various assistant elements as occasion demands, or may be formed in various shapes. In the embodiment of the present invention, the operation protrusion 53 is formed in a holder 52 which is inserted into the ON button 32 to couple to the ON button, and an inclined surface 53*a* is formed in one side of the operation protrusion 53. Here, the one side is a direction to which the ON button 32 moves forward. Therefore, when the ON button 32 moves forward, the operation protrusion 53 rotates the swing lever 54 to smoothly move forward. Also, the swing lever 54 couples to a boss in the case 12 to be horizontally rotatably disposed. A spring (S) couples to the swing lever 54 and the boss 12*a*. The swing lever 54 rotates with the operation protrusion 53. Moreover, an input lever 55 and output lever 56 are formed in the swing lever 54. End portion of the input lever 55 is formed in an inclined surface corresponding to the inclined surface 53*a* of the operation protrusion 53. The output lever 56 is formed in a side opposite to the input lever 55, and pushes the activation switch 70. Here, as shown in FIGS. 5 and 7*c*, when the ON button 32 is moving forward, if the swing lever 54 rotates with the operation protrusion 53, the output lever 56 returns to an initial position with the output lever 56 being supported by a plate spring 60 which is disposed in a direction opposite to the activation switch 70. Also, when the ON button 32 is returning to the initial position, after the predetermined time, the activation switch 70 operates with the output lever 56. Here, the predetermined time can be controlled with an elasticity of the spring (S) inserted.

FIGS. 7*a* to 7*e* are exemplary diagrams for describing an operation of a switch for preventing inrush current shock and cutting off standby power according to an embodiment of the present invention.

Figure 7A:
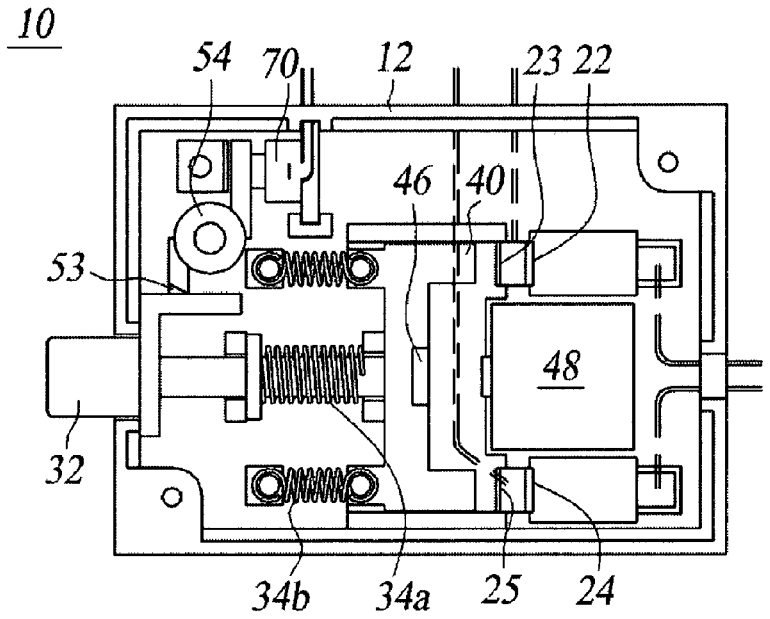
FIGS. 7*a* to 7*e* are exemplary diagrams for describing an operation of a switch for preventing inrush current shock and cutting off standby power according to an embodiment of the present invention.
Figure 7B:
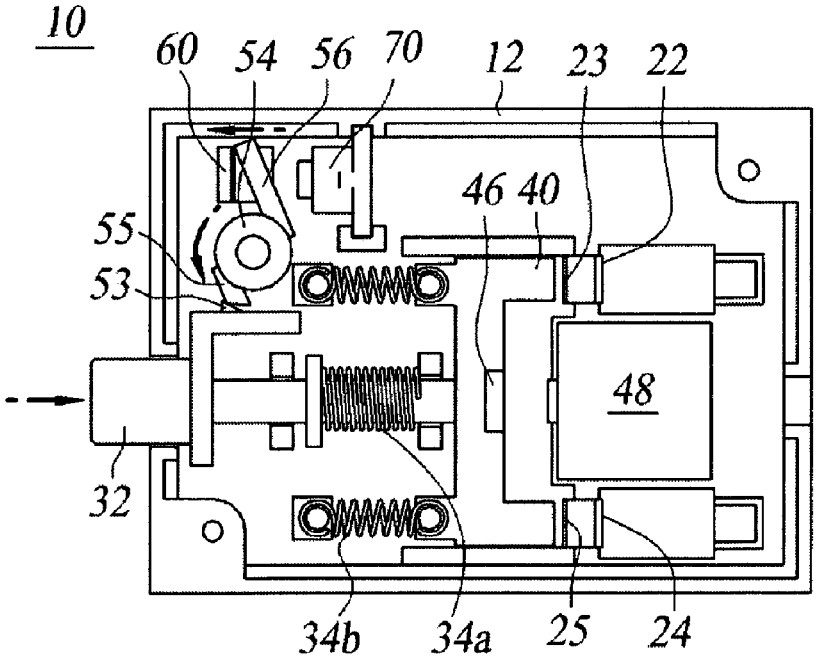
Figure 7C:
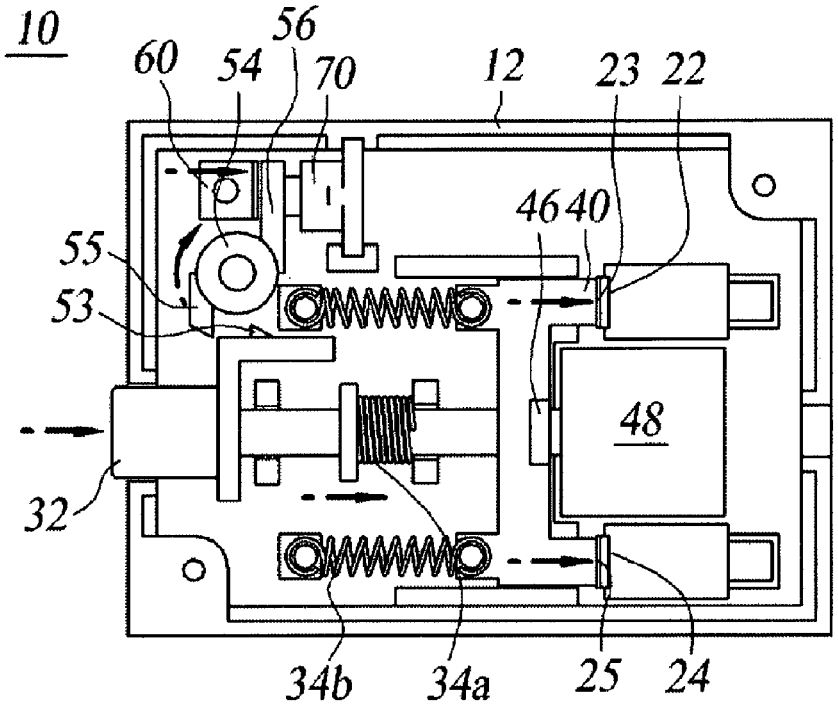
Figure 7D:
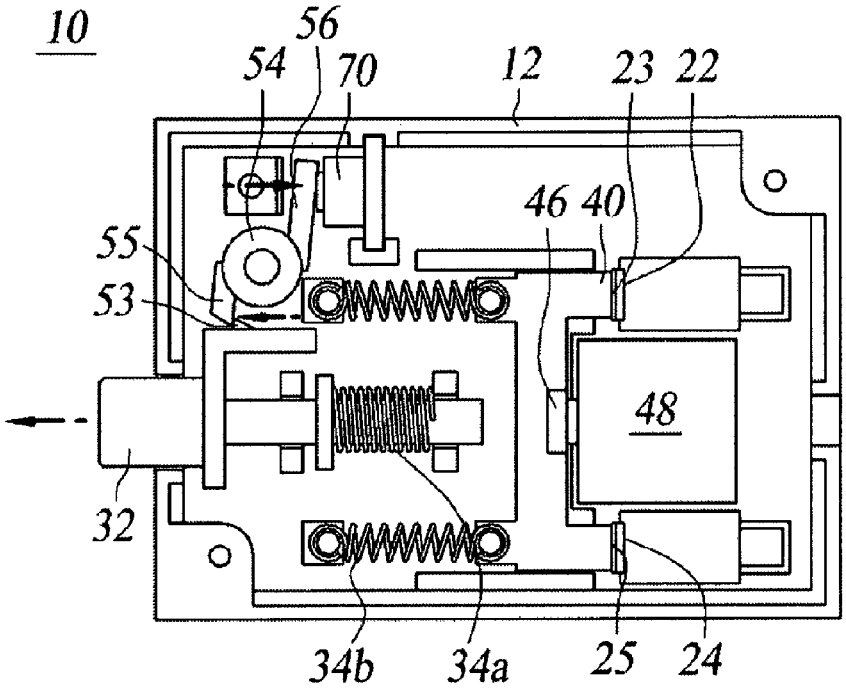

Referring to FIG. 7, FIG. 7*a* illustrates a state in which an electronic product turns off, and external power is cut off. In this state, if a user pushes the ON button 32, as shown in FIG. 7*b*, the ON button 32 moves forward, and the operation protrusion 53 pushes the input lever 55 of the swing lever 54 to move forward with the ON button 32. Then, the swing lever 54 rotates, and thus the output lever 56 pushes the plate spring 60. As shown in FIG. 7*c*, if the ON button 32 continuously moves forward, the operation protrusion 53 separates from the swing lever 54, and thus, the plate spring 60 applies elastic force to the output lever 56. Therefore, the swing lever 54 returns to an initial position. Also, the ON button 32 pushes the moving block 40 toward the electromagnet 48. Then, the magnet 46 formed in a central part of the moving block 40 is closely adjacent to the electromagnet 48, and the protrusion pushes one side of each of the first and second opening and closing terminals 23 and 25, and thus, the contact state of the first and second terminals 22 and 24, and the first and second opening and closing terminals 23 and 25 is maintained. At this point, due to the magnet 46 in the moving block 40, as shown in FIG. 7*d*, even when the ON button 32 moves backward, the moving block 40 is closely adjacent to the electromagnet 48 to be fixed, and thus, the contact state of the first and second terminals 22 and 24, and the first and second opening and closing terminals 23 and 25 is maintained.

In this way, when the ON button 32 is moving backward in the state of power being applied to the internal circuit 1, the operation protrusion 53 pushes the input lever 55 of the swing lever 54 toward a direction, in which the ON button moves backward, and thus, the swing lever 54 rotates, and the output lever 56 pushes the activation switch 70. Therefore, the activation switch 70 generates a control signal, and thus, the internal circuit 1 operates. Also, as shown in FIG. 7*e*, if the ON button 32 returns to an initial position, the swing lever 54 returns to initial position with elastic force of the activation switch 70 or the spring (S), but the moving block 40 continuously adheres to the terminal board 20.

Figure 7E:
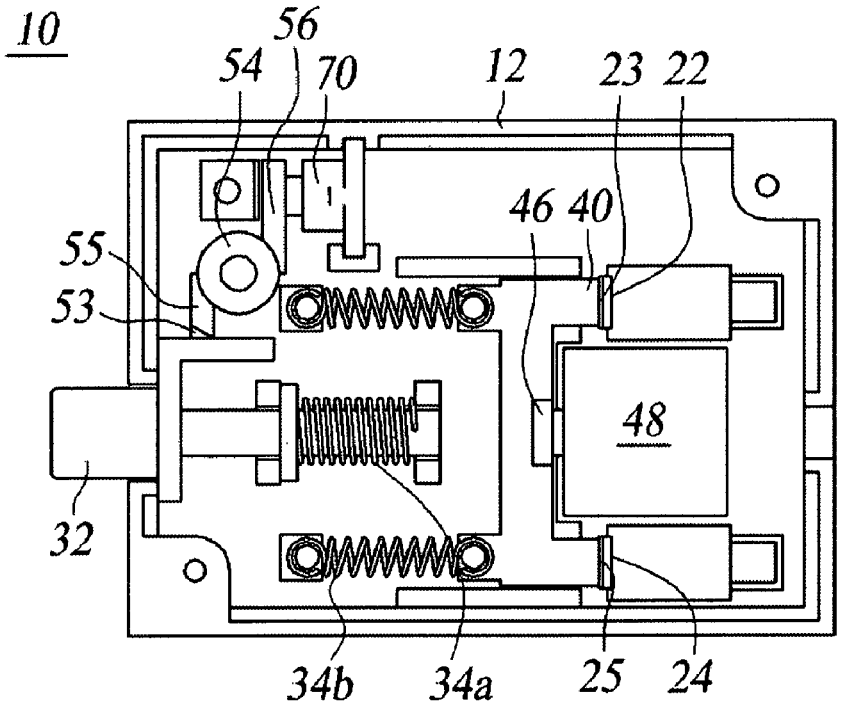

Again, in the state of FIG. 7*e*, if the ON button 32 again operates, the activation switch 70 generates a control signal (OFF signal) depending on a backward moving of the ON button 32 in the contact state of the first and second terminals 22 and 24, and the first and second opening and closing terminals 23 and 25. At this point, the internal circuit 1 turns off an electronic product, and the controller 80 makes a current flow through the electromagnet, and thus, the first and second opening and closing terminals 23 and 25, and the first and second terminals 22 and 24 separate from each other to open as shown in FIG. 7*a*.

Here, in the switch 10 for preventing inrush current shock and cutting off standby power according to an embodiment of the present invention, if an electronic product turns off by software or a control signal (OFF signal) of the activation switch 70 is generated in response to an operation of the ON button 32, the controller 80 makes a current flow through a solenoid coil to generate a magnetic field in the electromagnet 48. In this case, the electromagnet 48 has the same polarity as that of the magnet 46, and thus, pushing force occurs, the moving block 40 returns to an initial position with the spring 34*b*, and the contact switch opens. Therefore, external power is automatically cut off, and thus, standby power is cut off conveniently and efficiently. Moreover, it is possible to make a current flow through the electromagnet 48 with the controller 80 or the internal circuit 1 to change a polarity of the magnetic field to contact or open the first and second terminals 22 and 24, and the first and second opening and closing terminals 23 and 25. And thus latching relay can be used as the switch 10. In this case, constant power (for example, a battery) may be supplied to the internal circuit 1, the operation protrusion 53 may be disposed at one side of the moving block 40 of the power-on unit 30, and the delay unit 50 may be configured by mounting a spiral spring on the swing lever 54. Therefore, after the first and second opening and closing terminals 23 and 25, and the first and second terminals 22 and 24 contact each other, the activation switch 70 can generate a control signal (ON signal) after a predetermined time.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

The present invention can effectively prevent component damage, malfunction, deterioration of electricity quality, or the like, occurring when an electronic product turns on and cut off unwanted standby power completely when an electronic product turns off, and thus, the present invention can be widely applied to electrical products or electronic products.

The invention claimed is:

1. A switch for preventing inrush current shock and cutting off standby power, the switch comprising:

a first terminal and a second terminal contacting external power supplied to drive an electronic product;

a first opening and closing terminal and a second opening and closing terminal electrically contacting an internal circuit of the electronic product;

a power-on unit contacting or opening the first and second opening and closing terminals and the first and second terminals, and contacting the first and second opening and closing terminals and the first and second terminals to apply the external power to the internal circuit of the electronic product;

an activation switch generating a control signal depending on an operation of the power-on unit to control the internal circuit of the electronic product; and a delay unit for making the activation switch not operate while the power-on unit is trying to contact the first and second opening and closing terminals and the first and second terminals, delaying a predetermined time after the first and second opening and closing terminals contact the first and second terminals with the power-on unit and the external power is first applied to the internal circuit of the electronic product, and making the activation switch generate the control signal.

2. The switch of claim 1, wherein, the power-on unit comprises an operation protrusion making the activation switch generate the control signal, an ON button integrally formed with the operation protrusion, and a moving block elastically supported to be disposed between the ON button and the first and second terminals by a spring and transferred by the ON button, and the delay unit comprises at least one of a swing lever and a guide making the operation protrusion not cause the activation switch to operate while the ON button is transferring the moving block to contact the first and second opening and closing terminals to the first and second terminals.

3. The switch of claim 2 further comprising:

a controller controlling the first and second opening and closing terminals to separate from the first and second terminals to cut off a standby power;

a magnet integrally formed with the moving block; and an electromagnet disposed at a position facing the magnet, separating from the magnet depending on a polarity of a magnetic field controlled according to the control signal of the activation switch and transferring the moving block to separate the first and second opening and closing terminals from the first and second terminals.

* * * * *